US006719611B2

(12) United States Patent
Kordonski et al.

(10) Patent No.: US 6,719,611 B2
(45) Date of Patent: Apr. 13, 2004

(54) JET-INDUCED FINISHING OF A SUBSTRATE SURFACE

(75) Inventors: William Kordonski, Webster, NY (US); Arpad Sekeres, Rochester, NY (US)

(73) Assignee: QED Technologies, Inc., Rochester, NY (US)

( * ) Notice: Subject to any disclaimer, the term of this patent is extended or adjusted under 35 U.S.C. 154(b) by 6 days.

(21) Appl. No.: 10/033,856

(22) Filed: Dec. 20, 2001

(65) Prior Publication Data

US 2002/0173238 A1 Nov. 21, 2002

Related U.S. Application Data

(60) Provisional application No. 60/257,843, filed on Dec. 21, 2000.

(51) Int. Cl.[7] ..... B24C 1/08

(52) U.S. Cl. ..... 451/36; 451/42; 451/40

(58) Field of Search ..... 451/38–40, 60, 451/36, 37, 42, 104, 113; 901/41; 83/53, 177

(56) References Cited

U.S. PATENT DOCUMENTS 5,048,238 A * 9/1991 Ikeda ..... 451/36
5,573,446 A * 11/1996 Dey et al. ..... 451/39
5,591,068 A * 1/1997 Taylor et al. ..... 451/104
5,616,066 A * 4/1997 Jacobs et al. ..... 451/36
5,700,181 A * 12/1997 Hashish et al. ..... 451/40

* cited by examiner

*Primary Examiner*—Robert A. Rose
(74) *Attorney, Agent, or Firm*—Neal L. Slifkin; Harris Beach LLP

(57) ABSTRACT

Jet-induced finishing of a substrate surface includes means for covering the surface with an abrasive liquid slurry and means for impinging a jet of fluid, either a gas or a liquid, against the slurry to create a high-shear work zone on the substrate surface whereby portions of the substrate are lifted and removed to alter the shape of the surface towards a predetermined shape and/or smoothness. The surface may be covered as by cascading a flowing layer of slurry over it or by impinging slurry onto the work zone or by immersing the substrate in a pool of the slurry. A nozzle for dispensing the jet fluid is precisely located at a predetermined distance and angle from the surface to be finished. A coarse removal function is provided by disposing the nozzle tip at a first distance from the substrate surface, and a fine removal function is provided by disposing the nozzle closer to the substrate surface. The invention is generally useful for finishing optical elements, and especially for inexpensive forming of microlenses.

12 Claims, 6 Drawing Sheets

JET-INDUCED FINISHING OF A SUBSTRATE SURFACE

RELATIONSHIP TO OTHER APPLICATIONS

This application draws priority from a Provisional Application Ser. No. 60/257,843, filed Dec. 21, 2000.

DESCRIPTION

The present invention relates to method and apparatus for shaping rigid objects by grinding or polishing; more particularly, to method and apparatus for finishing by impingement of a fluid jet onto a rigid object, such as a glass or ceramic lens or a metal object; and most particularly, to method and apparatus for impinging a fluid jet, such as an air jet or a water jet, onto an abrasive-bearing liquid film in contact with a surface of an object to be shaped by removal of material therefrom.

It is known to use abrasive fluids to shape, finish, and polish objects, especially optical elements such as lenses and mirrors. See, for example, U.S. Pat. No. 5,951,369, "System for Magnetorheological Finishing of Substrates," issued Sep. 14, 1999 to Kordonsky et al. Also, see "Principles of Abrasive Water Jet Machining," byA Momber and R. Kovacevic, published by Springer-Verlag London, Ltd. (1998), especially pp. 328–330. As used herein, the term "grinding" means relatively rapid and coarse removal of material to change the global shape of an object; the term "polishing" means relatively slow and fine removal of material to reduce the micro-roughness of a surface already formed as by grinding or other gross process. As used herein, all removal processes, including grinding, polishing, and machining, whereby a surface is shaped, are referred to collectively as "finishing."

In the known art of jet finishing, a liquid slurry containing abrasive particles suspended in a liquid carrier medium is impinged at high velocity against a substrate surface to be finished. See, for example, U.S. Pat. No. 5,700,181, issued Dec. 23, 1997 to Hashish et al. The abrasive particles are sufficiently energetic to break loose particles of the substrate by mechanical attack, which substrate particles are then carried away by the slurry. Such finishing may be considered a form of mechanical grinding.

Jet impingement finishing as practiced in the known art has several serious shortcomings.

For example, the abrasive slurry typically must be maintained in a mixed state in a reservoir. Particulate abrasives typically are prone to rapid settling and thus require active mixing.

Further, the abrasive slurry must be pumped by a special abrasion-resistant pump through an abrasion-resistant delivery system and nozzle. Useful lifetimes of nozzles are known to be relatively short.

Still further, the abrasive particles are prone to settling in the slurry delivery system, thereby causing blockages and stopping flow.

Still further, known finishing systems are not well-suited to finishing very small objects or surfaces, for example, the ends of fiber-optic strands. The minimum diameter of the jet is limited by the size of the abrasive particles, or clumps thereof, which must be delivered through the nozzle. Very small diameter nozzles are readily clogged, and high pumping pressures are required to maintain high-velocity flow. Thus there is a practical lower limit on the size of substrates which may be finished by prior art apparatus and methods.

What is needed is a method and apparatus for fluid jet surface finishing of micro- and nano-sized objects.

It is a principal object of the invention to provide an improved method and apparatus for jet finishing wherein the minimum size of the surface to be finished is not limited by the size of the abrasive particles nor the diameter of a nozzle for impinging an abrasive jet thereupon. It is further object of the invention to provide an improved method and apparatus for jet finishing by a nozzle wherein the nozzle cannot be plugged by abrasive particles.

It is a still further object of the invention to provide an improved method and apparatus for jet finishing wherein both grinding and polishing may be performed by adjustment of a given finishing apparatus.

It is a still further object of the invention to provide an improved method and apparatus for inexpensively forming microlenses.

Briefly described, a method and apparatus for finishing of a substrate surface in accordance with the invention includes means for covering the surface with a liquid slurry containing abrasive particles and means for impinging a jet of fluid, preferably air or water, against the slurry to accelerate the particles and induce formation of a high-shear work zone on the substrate surface wherein portions of the substrate are lifted and removed by the slurry to alter the shape of the substrate surface towards a predetermined shape and/or smoothness. The surface may be covered, for example, by cascading a flowing layer of slurry over it, or by impinging slurry onto the work zone, or by immersing the substrate in a pool of the slurry, or the like. The jet is provided, for example, by a tubular nozzle having an exit orifice which may be precisely located at a predetermined distance from the surface to be finished. A coarse removal function may be provided by establishing the exit orifice at a first distance from the substrate surface, and a fine removal or polishing function may be provided by placing the exit orifice at a second and closer distance from the substrate surface. Further, the areal shape of the removal function may be varied by varying the distance and angle between the nozzle and the substrate; and at certain spacings, the function is radially bimodal, permitting simple and inexpensive formation of curved surfaces such as microlenses. The nozzle may be oriented such that the axis of the jet forms a predetermined angle with the surface to be finished, between 0° and 90°. The exit orifice may be immersed in the slurry or may be disposed in space above the free surface of the slurry. The slurry may be aqueous or otherwise. Preferably, the slurry has a viscosity somewhat higher than that of water, such that a substantial rate of surface shear is induced in the slurry by the impingement of the jet. Preferably, the substrate and/or the nozzle may be controllably moved past one another to obtain the desired contour or smoothness of the substrate surface.

The foregoing and other objects, features, and advantages of the invention, as well as presently preferred embodiments thereof, will become more apparent from a reading of the following description in connection with the accompanying drawings in which.

Figure 1:
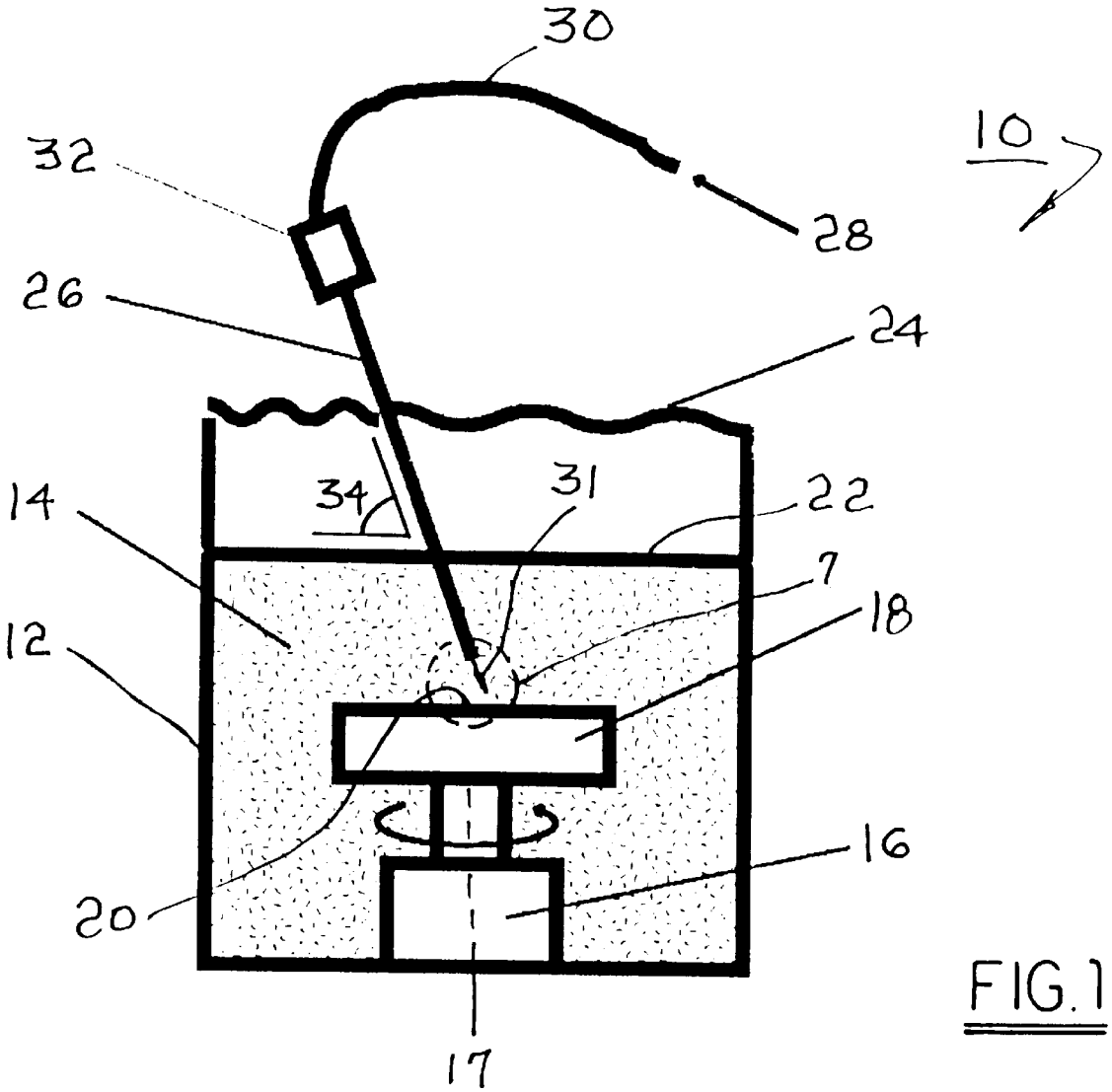
FIG. 1 is a schematic elevational cross-sectional view of an apparatus in accordance with the invention, showing a jet-producing nozzle submerged in a pool of abrasive slurry for finishing a substrate.

Referring to FIG. 1, a first embodiment 10 of an apparatus for jet-induced finishing of a substrate includes a vessel 12 for holding a volume of an abrasive slurry 14. Slurry 14 may be a conventional suspension of abrasive particles, for example, cerium oxide, dispersed in a liquid medium, or any other formulation of particulate abrasive in a liquid medium. Within vessel 12 is a mounting means 16 for holding, and preferably also rotating about a vertical axis 17, a substrate 18 having a surface 20 to be finished by apparatus 10. The depth of the volume of slurry 14 is such that surface 20 is submerged below the upper liquid surface 22 of slurry 14. Preferably, vessel 12 is provided with a cover 24 to minimize loss of slurry from splattering during operation of the apparatus.

Figure 7:
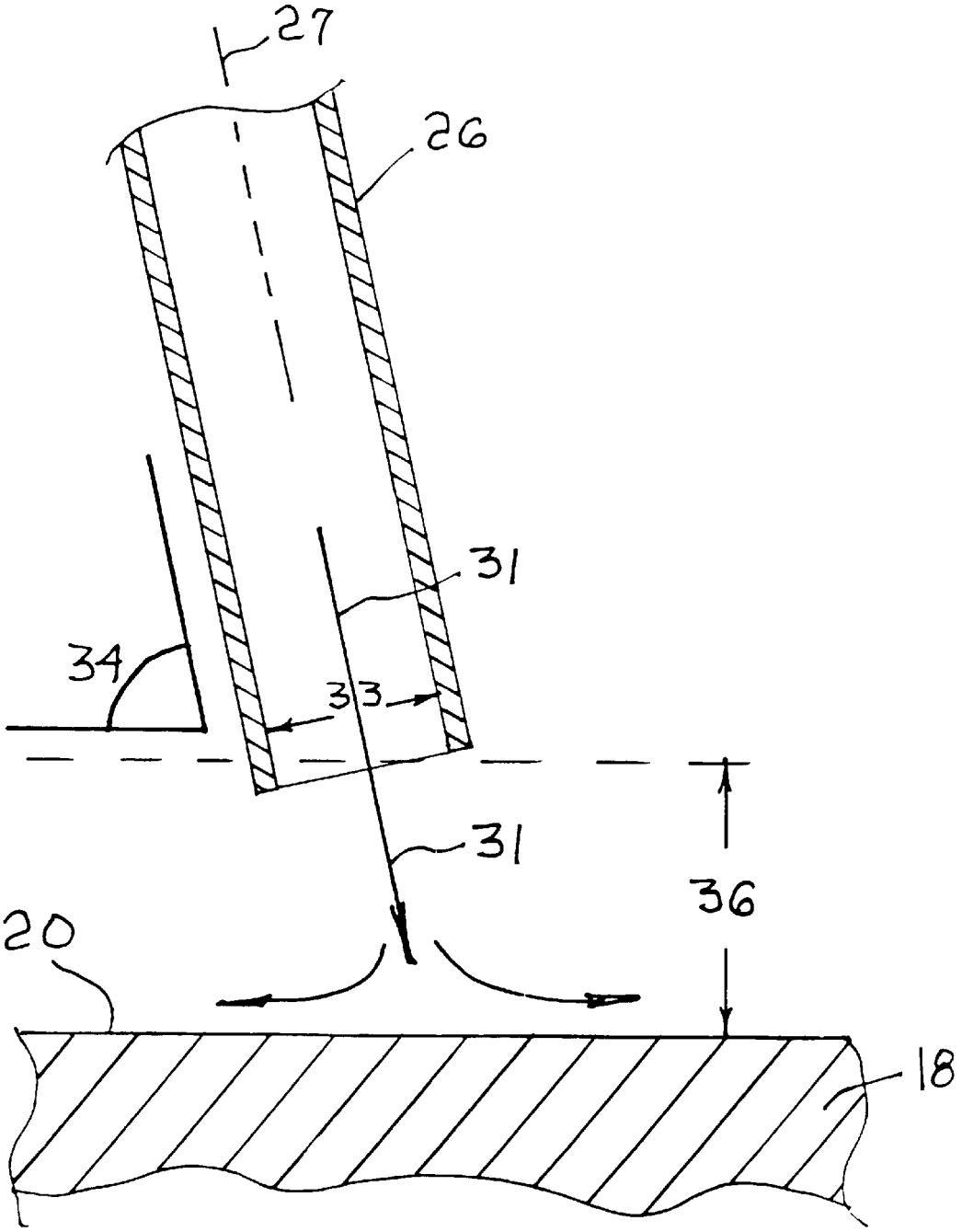
FIG. 7 is an enlarged and detailed view of the area shown in circle 7 in FIG. 1.

Extending through cover 24 toward substrate surface 20 is a hollow nozzle 26 connected to a fluid medium supply 28 via a line 30 and a manifold 32. A collimated jet 31 of fluid is directed from nozzle 26 toward surface 20. The fluid provided by supply 28 may be either a gas, such as, but not limited to, compressed air, or a liquid, such as, but not limited to, pressurized water. The flow volume of fluid medium supplied through nozzle 26 may be regulated as desired by well known conventional means (not shown). Nozzle 26 has an axis 27 of discharge flow. Nozzle 26 may be disposed at any desired angle 34 to surface 20 from 0° (parallel to the surface) to 90° (orthogonal to the surface). At a 90° nozzle angle, fluid relationships at surface 20 are substantially circularly symmetrical. Nozzle 26 has a diameter 33 of the discharge tip 35, which tip may be disposed at any desired distance 36 from surface 20, as shown in FIG. 7. For purposes of explanation, the ratio of distance 36 to diameter 33 is a convenient metric.

Figure 3:
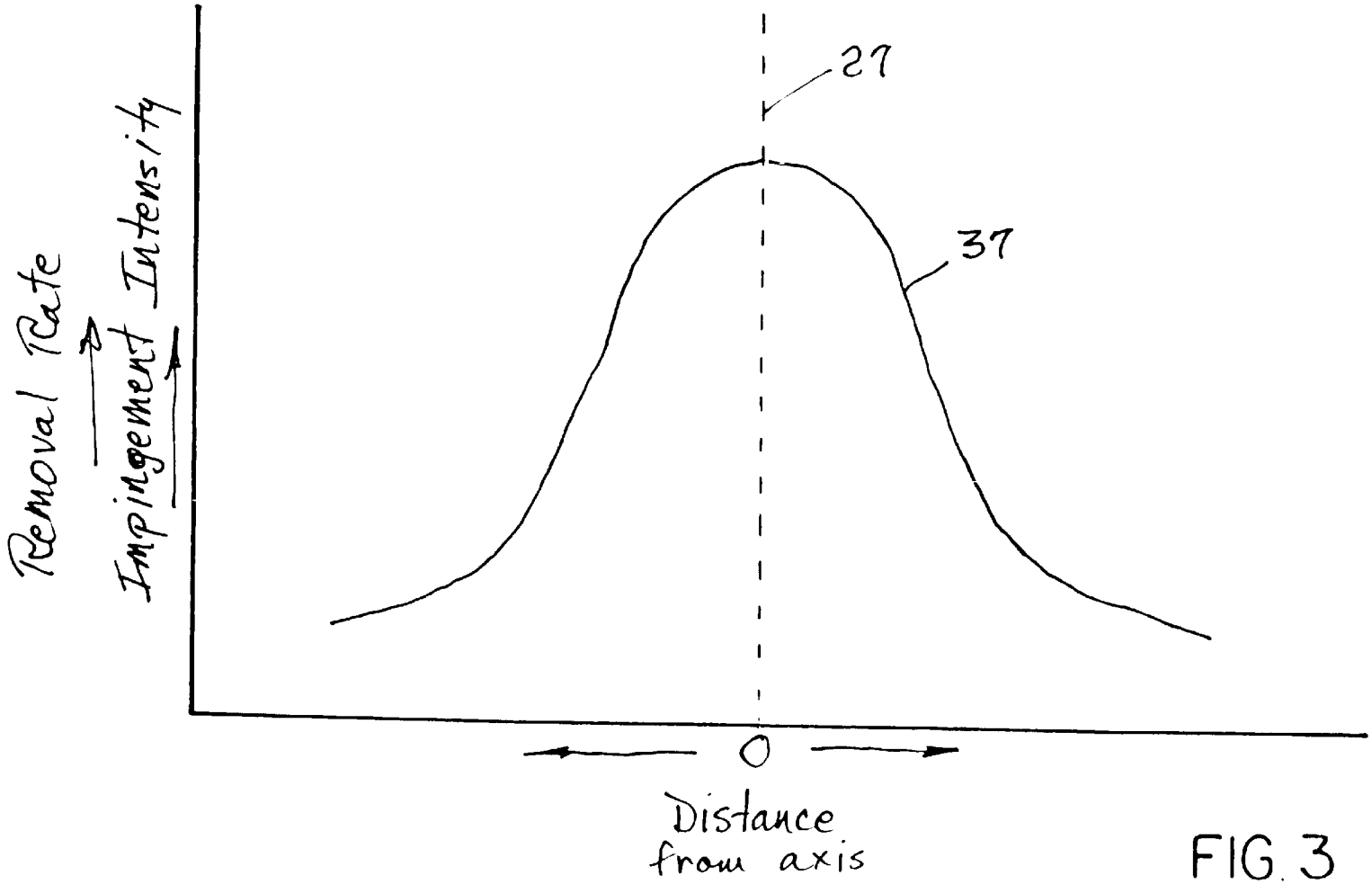
FIG. 3 is a graph showing a profile of removal rate of a substrate by normal impingement of a jet upon a slurry from a distance of the nozzle from the substrate of about 6 nozzle diameters.

Referring to FIGS. 1 and 3, in a first preferred mode of operation, nozzle 26 is disposed at a distance of about 5–6 diameters from substrate surface 20 at an impingement angle of 90°. A fluid jet 31 exiting nozzle 26 accelerates abrasive particles already present in the slurry toward surface 20. The rate of removal of material from surface 20 is proportional to the intensity of impingement, as indicated by a bell-shaped curve 37 symmetrical about axis 27. This removal mode is said to be "brittle" and involves energetic thrusting of particles against surface 20. These conditions are useful for general removal of material in finishing, comparable to conventional jet finishing wherein the abrasive particles are delivered through the nozzle rather than being secondarily accelerated by a supplementary fluid jet 31. Such particulate attack, however, can cause sub-surface damage in the finished surface in the form of micro-cracks.

Figure 4:
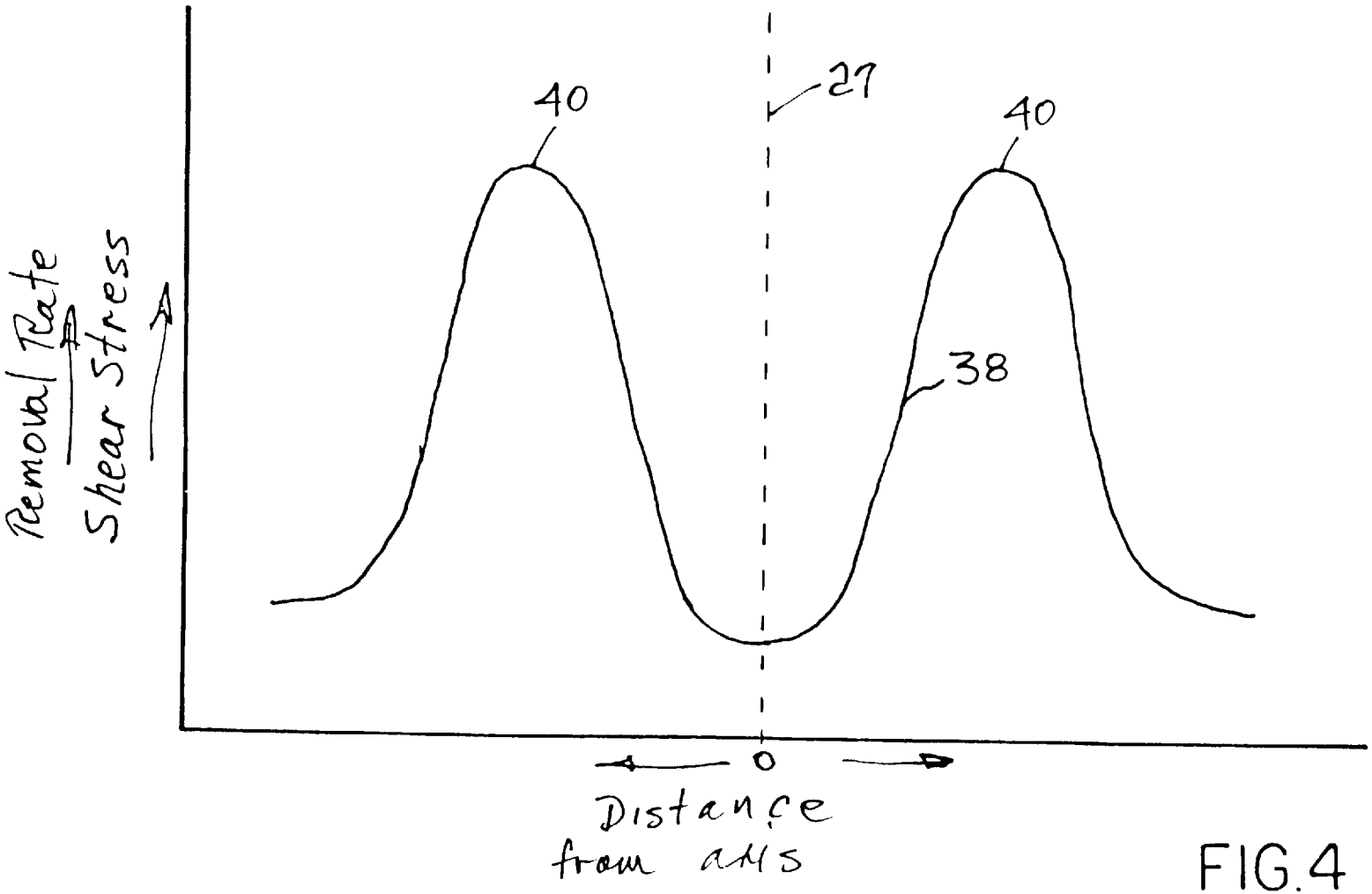
FIG. 4 is a graph like that shown in FIG. 3, showing a profile of removal rate at a nozzle distance of about 2 nozzle diameters.

Referring to FIGS. 1 and 4, a surprising and unexpected phenomenon is illustrated. As nozzle tip 35 is disposed closer to surface 20, for example, at about 1–2 nozzle diameters, the profile 38 of removal rate changes dramatically from what is shown in FIG. 3. The removal rate on axis 27 is diminished and increases radially to a maximum 40 and then decreases. An analysis of the fluid flow which results from the interaction of the jet and the slurry shows that the removal rate profile correlates to the radial distribution of the surface shear stress induced by the slurry flow over surface 20. In other words, the inventor believes that at relatively close spacings of the nozzle tip to the work surface, removal of material occurs from induced surface shear stress rather than from abrasive particle inpingement at an angle to the surface. This removal mode is said to be "ductile" and has the advantage relative to the impingement mode of not producing sub-surface damage in surface 20.

Figure 6:
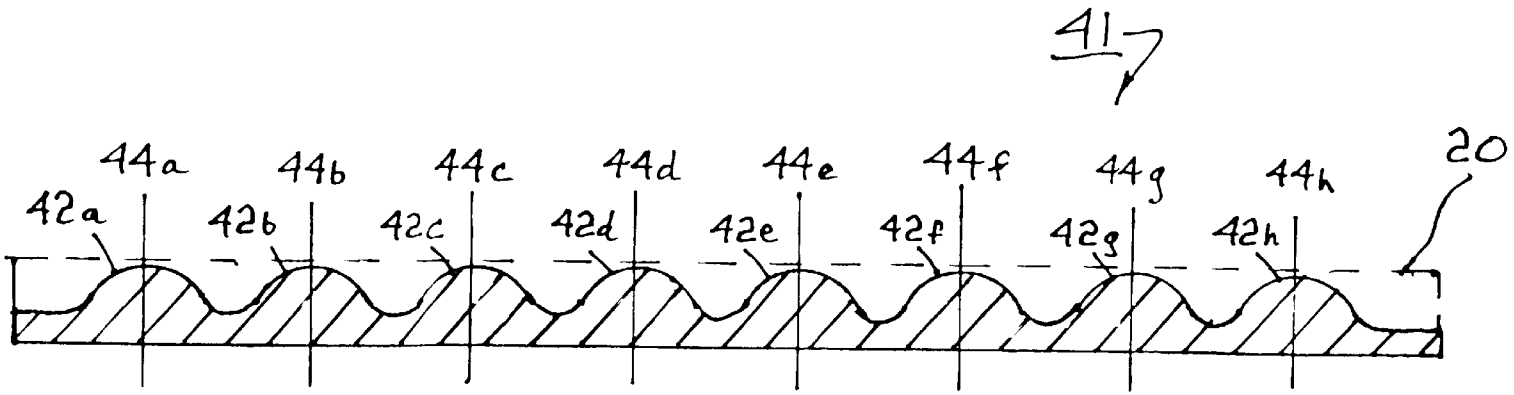
FIG. 6 is a cross-sectional view taken along line 6—6 in FIG. 5.
Figure 5:
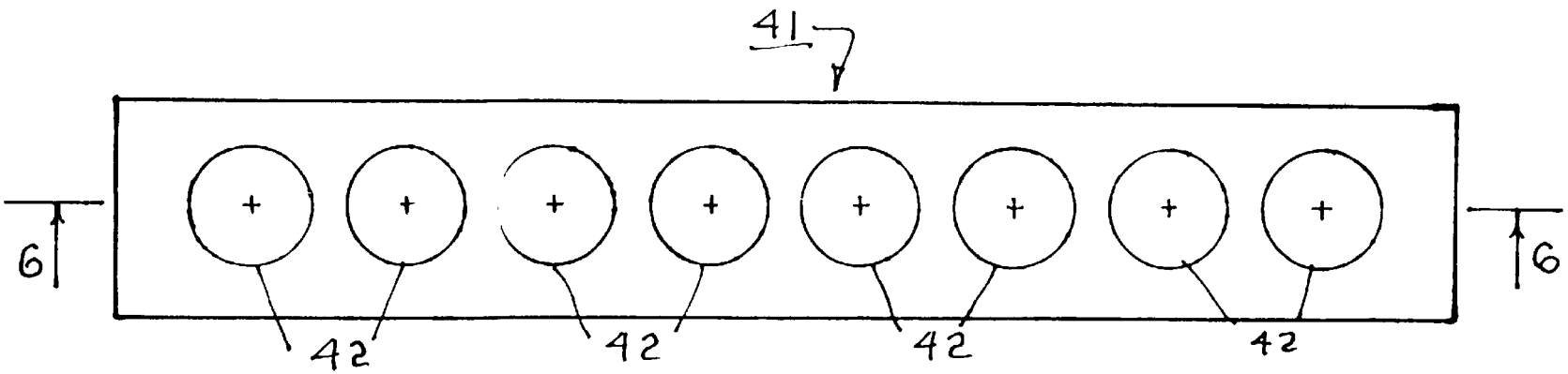
FIG. 5 is a plan view of a series of microlenses formed by stepwise indexing of a finishing apparatus in accordance with the invention.

Referring to FIGS. 5 and 6, a useful application of the invention is in the formation of an array 41 of microlenses 42. Such lenses have a diameter typically between about 5 mm and about 20 $\mu$m. An apparatus in accordance with the invention may be configured to operate intermittently. Revolution of means 16 generally is not necessary because of the radial symmetry of the removal function illustrated by curve 38. The shape and slopes of curve 38 required for forming a particular lens can be determined easily without undue experimentation according to the substrate material to be formed as the lens array, for example, glass or plastic. A nozzle 26 preferably has a nozzle diameter 35 comparable to the desired diameter of each lens 42. A material blank for forming the array is disposed on mounting means 16 at a first axial position 44*a*. Supply 28 is energized for a predetermined length of time and flow intensity. Surface 20 is shaped by jet-induced stress to form a first microlens 42*a*. The jet is shut off, the blank is indexed laterally by a predetermined amount to a second position 44*b*, supply 28 is again energized, and a second microlens 42*b* is formed. Similarly, the process is repeated stepwise across the blank to produce, successively, lenses 42*a* through 42*h*. The lenses may then be severed from the blank for individual use. Of course, array 41 may extend also in the Y direction to include a plurality of additional rows of microlenses 42, as desired.

Figure 2:
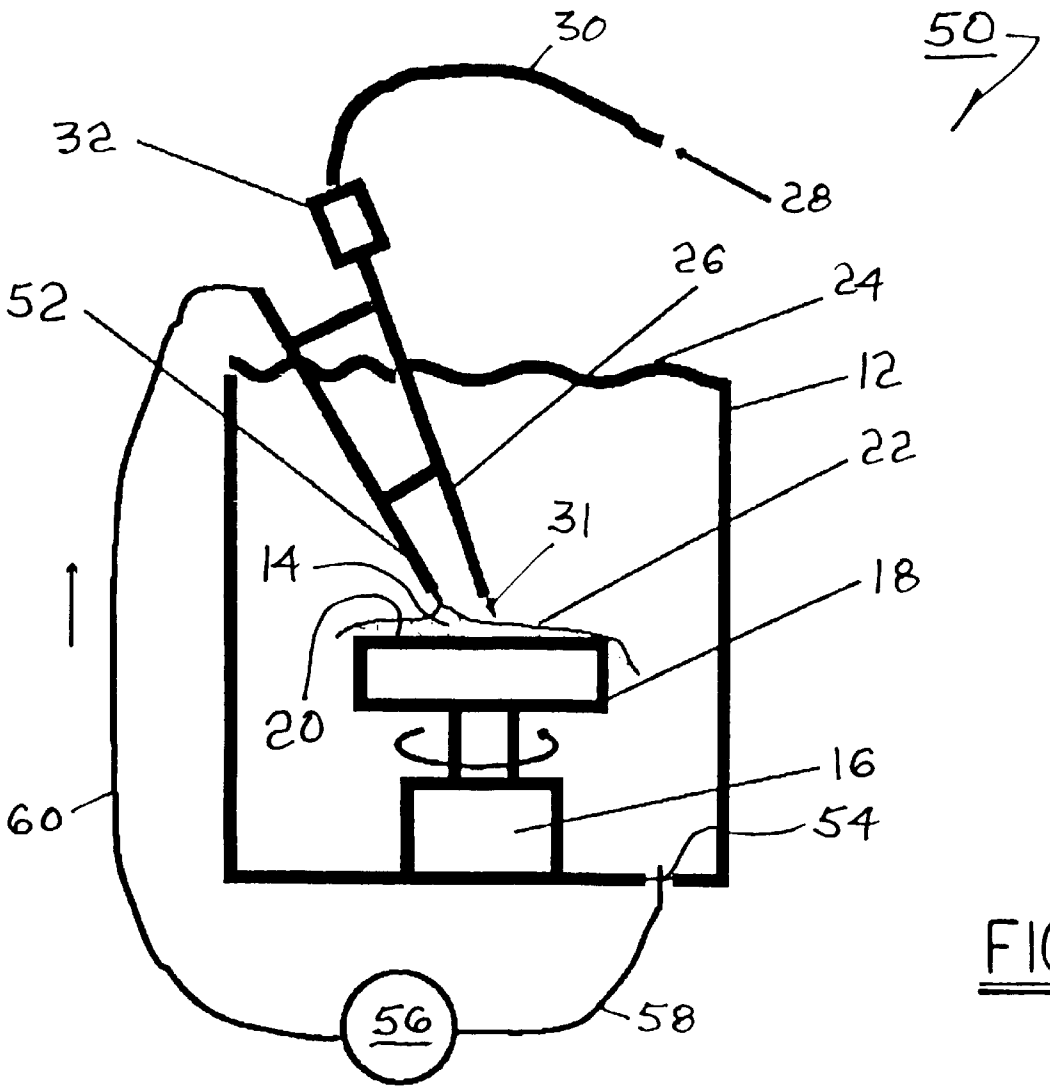
FIG. 2 is a view similar to that shown in FIG. 1, showing a jet-producing nozzle mounted above a layer of abrasive slurry being applied via a second nozzle.

Referring to FIG. 2, a second embodiment 50 of an apparatus in accordance with the invention is similar to embodiment 10. However, rather than having the entire mounting means 16 immersed in slurry 14, an auxiliary nozzle 52 feeds slurry 14 at low velocity onto surface 20 for jet-induced finishing of the surface substantially identically to that provided by embodiment 10. Nozzle 26 may or may not be immersed in slurry 14. Slurry 14 flows and is forced off surface 20 by jet 31, and collects at the bottom of vessel 12, which is provided with an outlet 54. A recirculation pump 56 is connected between outlet 54 and auxiliary nozzle 52 by hoses 58 and 60, whereby slurry 14 is supplied continuously onto surface 20.

From the foregoing description, it will be apparent that there has been provided an improved method and apparatus for jet-induced finishing of a substrate surface, wherein a jet of fluid is impinged against an abrasive liquid slurry on the substrate surface whereby portions of the substrate are lifted and removed by the slurry to alter the shape of the substrate surface towards a predetermined shape and/or smoothness. Variations and modifications of the herein described method and apparatus, in accordance with the invention, will undoubtedly suggest themselves to those skilled in this art. Accordingly, the foregoing description should be taken as illustrative and not in a limiting sense.

What is claimed is:

1. A system for jet-induced finishing of a substrate surface, comprising:

a) means for covering said surface with a liquid slurry containing abrasive particles; and b) means for impinging a jet of a fluid against said slurry, said fluid being free of particles, to induce shear in said slurry adjacent said substrate surface whereby portions of said substrate are removed to alter the shape of said substrate surface towards a predetermined shape.

2. A system in accordance with claim 1 wherein said means for covering is selected from the group consisting of a pool and an auxiliary jet.

3. A system in accordance with claim 1 wherein said means for impinging includes a nozzle having an exit tip having a diameter.

4. A system in accordance with claim 3 wherein said nozzle tip is off-spaced from said substrate surface by a distance less than about six of said nozzle diameters.

5. A system in accordance with claim 4 wherein said distance is less than about two nozzle diameters.

6. A system in accordance with claim 3 wherein said nozzle tip is immersed in said slurry.

7. A system in accordance with claim 3 wherein said nozzle tip is above a free upper surface of said slurry.

8. A system in accordance with claim 1 wherein said fluid free of particles is selected from the group consisting of a gas and a liquid.

9. A system in accordance with claim 8 wherein said gas is air.

10. A system in accordance with claim 8 wherein said liquid is water.

11. A method for jet-induced finishing of a substrate surface, comprising the steps of:

a) covering said surface with a liquid slurry containing abrasive particles; and b) impinging a jet of a fluid against said slurry, said fluid being free of particles, to induce shear stress in said slurry adjacent said substrate surface whereby portions of said substrate are removed to alter the shape of said substrate surface towards a predetermined shape.

12. A method in accordance with claim 11 including the further steps of:

a) providing a nozzle for said impinging of said jet, said nozzle having an exit tip having a diameter; and b) positioning said nozzle tip at a distance less than about two nozzle diameters from said substrate surface.

* * * * *